US009541892B2

(12) United States Patent
Hashimoto

(10) Patent No.: US 9,541,892 B2
(45) Date of Patent: Jan. 10, 2017

(54) IMAGE FORMING APPARATUS INCLUDING FIXING DEVICE

(71) Applicant: Brother Kogyo Kabushiki Kaisha, Nagoya-shi, Aichi-ken (JP)

(72) Inventor: Yohei Hashimoto, Nagakute (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/014,106

(22) Filed: Feb. 3, 2016

(65) Prior Publication Data

US 2016/0231691 A1 Aug. 11, 2016

(30) Foreign Application Priority Data

Feb. 6, 2015 (JP) ..... 2015-021909

(51) Int. Cl.
*G03G 15/00* (2006.01)
*G03G 15/20* (2006.01)
*G03G 21/16* (2006.01)

(52) U.S. Cl.
CPC ..... *G03G 21/1623* (2013.01); *G03G 15/2035* (2013.01); *G03G 21/1685* (2013.01)

(58) Field of Classification Search
CPC ..... G03G 15/2032; G03G 15/2035; G03G 15/2067; G03G 15/2071; G03G 21/1633; G03G 21/1647; G03G 21/1685; G03G 2221/1639; G03G 21/1623
USPC ..... 399/122, 110
See application file for complete search history.

(56) References Cited

U.S. PATENT DOCUMENTS

| | | | | |
|---|---|---|---|---|
| 9,098,025 | B2 | 8/2015 | Masuda | |
| 2003/0118382 | A1* | 6/2003 | Tomatsu | G03G 15/2064 399/328 |
| 2010/0028044 | A1* | 2/2010 | Matsuo | G03G 15/2035 399/122 |
| 2010/0254728 | A1* | 10/2010 | Iwase | G03G 15/2035 399/122 |
| 2012/0082478 | A1* | 4/2012 | Wang | G03G 21/1633 399/110 |
| 2012/0219324 | A1 | 8/2012 | Masuda | |

(Continued)

FOREIGN PATENT DOCUMENTS

| | | |
|---|---|---|
| JP | 2011-215207 A | 10/2011 |
| JP | 2012-177743 A | 9/2012 |
| JP | 2013-137580 A | 7/2013 |

*Primary Examiner* — Sophia S Chen
(74) *Attorney, Agent, or Firm* — Banner & Witcoff, Ltd.

(57) ABSTRACT

An image forming apparatus includes a housing, a conveying member, a nip member, an urging member, a changing portion, a first transmission portion, a motor, a second transmission portion, and a switching member. The urging member is configured to urge one of the conveying member and the nip member. The changing portion is configured to change an urging force of the urging member. The opening/closing member is configured to generate a moving force when being moved. The second transmission portion is configured to transmit drive force of the motor to the first transmission portion to generate the moving force. The switching member is configured to switch to one of a transmitting state and a cutoff state. The switching member interrupts the transmission of the drive force from the second transmission portion to the first transmission portion in the cutoff state.

11 Claims, 10 Drawing Sheets

(56) References Cited

U.S. PATENT DOCUMENTS

2015/0093124 A1* 4/2015 Miyake ..... G03G 21/1633
399/18

* cited by examiner

IMAGE FORMING APPARATUS INCLUDING FIXING DEVICE

CROSS REFERENCE TO RELATED APPLICATION

This application claims priority from Japanese Patent Application No. 2015-021909 filed Feb. 6, 2015. The entire content of the priority application is incorporated herein by reference.

TECHNICAL FIELD

The present disclosure relates to an image forming apparatus including a fixing device.

BACKGROUND

Among the various conventional image forming apparatuses in the art, there are electro-photographic type image forming apparatuses provided with a fixing device for fixing a toner image on a sheet. The image forming apparatus includes a housing, a heat member, and a pressure member in pressure contact with the sheet in cooperation with the heat member. The image forming apparatus is provided with a front cover to cover a front opening of the housing. A nip pressure between the heat member and the pressure member can be changed in interlocking relation to opening/closing motion of the front cover. More specifically the nip pressure at opening state of the front cover is set smaller than the nip pressure at closing state of the front cover for facilitating sheet removal when sheet jamming occurs.

SUMMARY

Recently, improvement on operability to the front cover is required. Specifically, an image forming apparatus capable of decreasing user's burden for opening or closing motion of the front door is required. However, according to the conventional image forming apparatus, the front cover must be opened against urging force of a spring member which urges the heat member toward the pressure member in case where the nip pressure at the open state of the front cover should be lower than the nip pressure at the closed state thereof, i.e., in case where the nip pressure has to be changed. Therefore, opening or closing operation of the front cover may place a burden on the user as changing the nip pressure.

It is therefore an object of the present disclosure to provide an image forming apparatus capable of reducing the burden caused by opening or closing operation of the front cover.

According to one aspect, an image forming apparatus includes, a housing, a nip member, a conveying member, an urging member, a changing portion, an opening/closing member, a first transmission portion, a motor, a second transmission portion, and a switching member. The housing is formed with an opening. The conveying member is configured to convey a recording sheet. The nip member has a nip portion configured to nip the recording sheet in cooperation with the conveying member. The urging member is configured to urge one of the conveying member and the nip member toward another of the conveying member and the nip member. The changing portion is configured to change an urging force of the urging member. The opening/closing member is configured to move between an opening position to uncover the opening and a closing position to cover the opening. The opening/closing member is configured to generate a moving force when being moved. The first transmission portion is configured to be moved by the moving force and transmit the moving three to the changing portion. The motor is configured to generate a drive force. The second transmission portion is configured to transmit the drive force to the first transmission portion to generate the moving force. The switching member is configured to switch to one of a transmitting state and a cutoff state. The switching member interrupts the transmission of the drive force from the second transmission portion to the first transmission portion in the cutoff state. The second transmission portion transmits the drive force to the first transmission portion in the transmitting state.

BRIEF DESCRIPTION OF THE DRAWINGS

The particular features and advantages of the disclosure will become apparent from the following description taken in connection with the accompanying drawings, in which.

DETAILED DESCRIPTION

Figure 1:
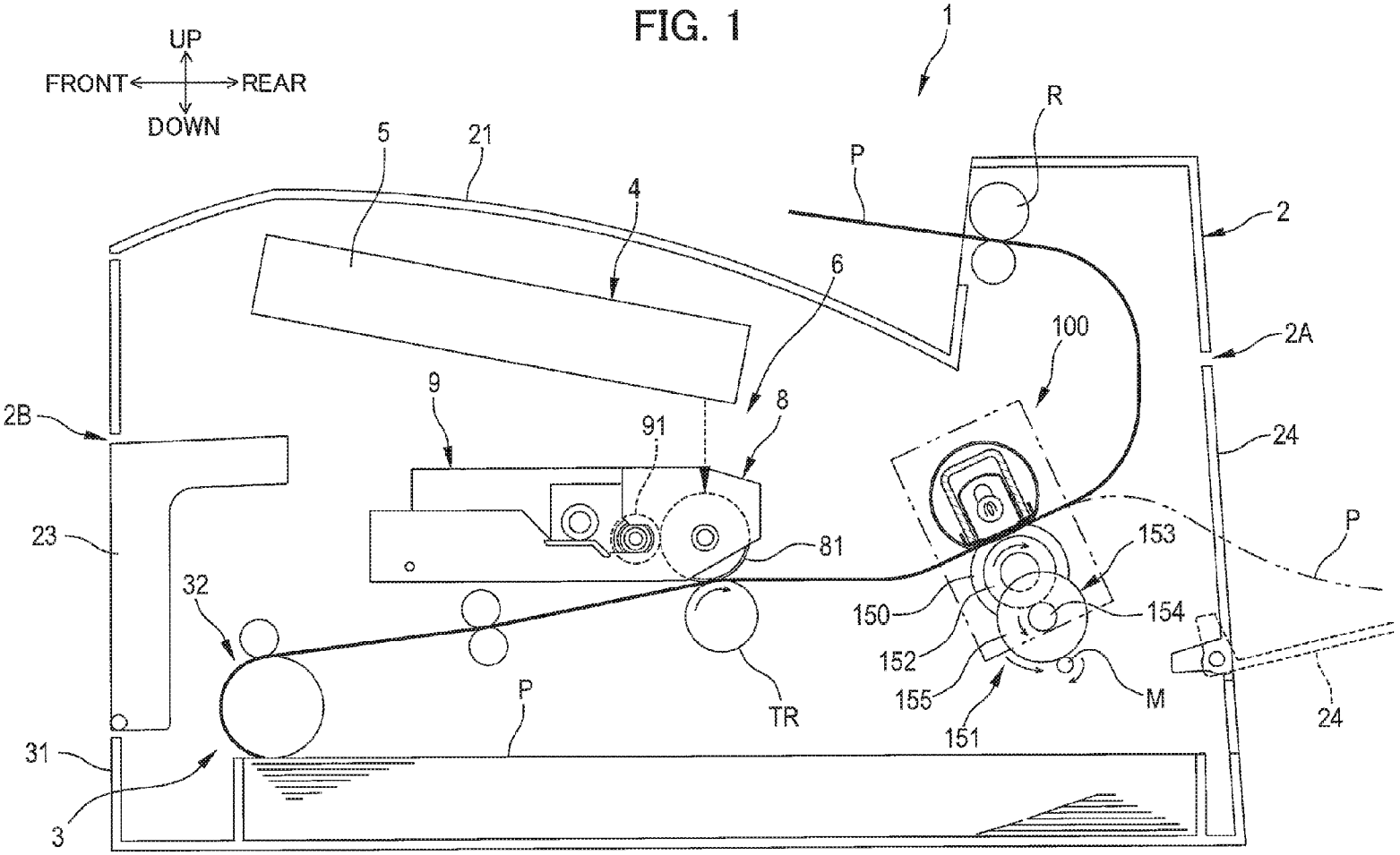
FIG. 1 is a schematic cross-sectional view of an image forming apparatus according to an embodiment.

An overall structure of an image forming apparatus, i.e., a printer 1 according to an embodiment will be described with reference to FIG. 1. Then, specific structure in the embodiment will be described with reference to FIGS. 2 through 11. In the drawings, directions will be based on an assumption that the printer 1 is disposed in an orientation in which it is intended to be used. Specifically, the left side of the printer 1 in FIG. 1 will be called the "front," the right side will be called the "rear," the near side will be called the "right," and the far side will be called the "left."

As shown in FIG. 1, the printer 1 includes a casing 2. Within the casing 2, provided are a feeder unit 3 for supplying a sheet P (recording sheet), an image forming unit 4 for forming an image on the sheet, a control unit 50 (see FIG. 2), and an interlocking mechanism 300 (see FIG. 6).

The feeder unit 3 includes a sheet supply tray 31 detachably provided in a lower portion of the casing 2, and a sheet supplying mechanism 32 for supplying the sheet P in the sheet supply tray 31 toward the image forming unit 4.

The image forming unit 4 includes a scanner unit 5, a process unit 6, a transfer roller TR, and a fixing unit 100.

The scanner unit 5 is provided in an upper portion of the casing 2. Although not shown in the drawings, the scanner unit 5 includes a laser light-emitting unit, a polygon mirror, lenses, and reflecting mirrors. The scanner unit 5 is configured to irradiate laser beam (indicated by dotted chain lines in FIG. 1) to expose a surface of a photosensitive drum 81 (described later) to light by way of high speed scanning.

The process unit 6 is attachable to and detachable from the casing 2 and is positioned between a front cover 23 (described later) and the fixing unit 100. The process unit 6 includes a drum cartridge 8 including the photosensitive drum 81 and a developing cartridge 9 including a developing roller 91 and containing a toner.

In the process unit 6, a surface of the rotating photosensitive drum 81 is uniformly charged by a charger (not shown), after which the scanner unit 5 irradiates laser beam to expose surface of the photosensitive drum 81 to light at high speed scanning. Thus, a potential of an exposed area is lowered to form an electrostatic latent image on the surface of the photosensitive drum 81 on the basis of the image data.

Then, toner accommodated in the developing cartridge 9 is supplied to the electrostatic latent image formed on the photosensitive drum 81 by the rotating developing roller 91. Thus, the electrostatic latent image becomes a visible toner image on the surface of the photosensitive drum 81. Then, the sheet P is conveyed between the photosensitive drums 81 and the transfer roller TR, so that the toner image formed on the photosensitive drums 81 is transferred to the sheet P.

The fixing unit 100 is disposed rearward of the process unit 6. The toner image transferred onto the sheet P is thermally fixed upon the sheet being passed through the fixing unit 100. Thereafter, the sheet P is conveyed to a discharge roller R positioned downstream of the fixing unit 100 in a sheet conveying direction, and is then conveyed to a discharge tray 21 by the discharge roller R.

The casing 2 is formed with a first opening 2A at a position rearward of the fixing unit 100 and a second opening 2B independent of the first opening 2A at a position frontward of the process unit 6. A rear cover 24 is supported to the casing 2 and is pivotally movable about a pivot axis to an open position opening the first opening 2A and to a closed position closing the first opening 2A. Further, the front cover 23 as an example of the opening/closing member is supported to the casing 2 and is pivotally movable about a pivot axis to an open position opening the second opening 2B and to a closed position closing the second opening 2B.

Further, interlock switches 700, 701 (FIG. 2) as examples of a position detector are provided in the casing 2 for detecting positions of the front cover 23 and the rear cover 24. Each of the interlock switches 700, 701 is a conventional micro-switch in which an internal terminal is rendered ON and OFF upon application of pressure to a lever (not shown). In the depicted embodiment, the interlock switches 700, 701 are pressed by a part of the front cover 23 and a part of the rear cover 24, respectively.

Upon release of the pressure application to the levers, the control unit 50 detects that the front cover 23 or the rear cover 24 is at position other than closed position. On the other hand, upon application of the pressure to each of the levers, the control unit 50 detects that the front cover 23 and the rear cover 24 are at the closed positions. Incidentally, in the present specification, movement of the front and rear covers from their closed positions will be referred to as "opening movement", and movement of the front and rear covers from their open positions will be referred to as "closing movement."

In the present embodiment, positions of the front cover 23 and the rear cover 24 are detected by the interlock switches 700, 701. However, instead of the interlock switches, conventional optical sensors may be used for detecting positions of the covers 23, 24.

Figure 2:
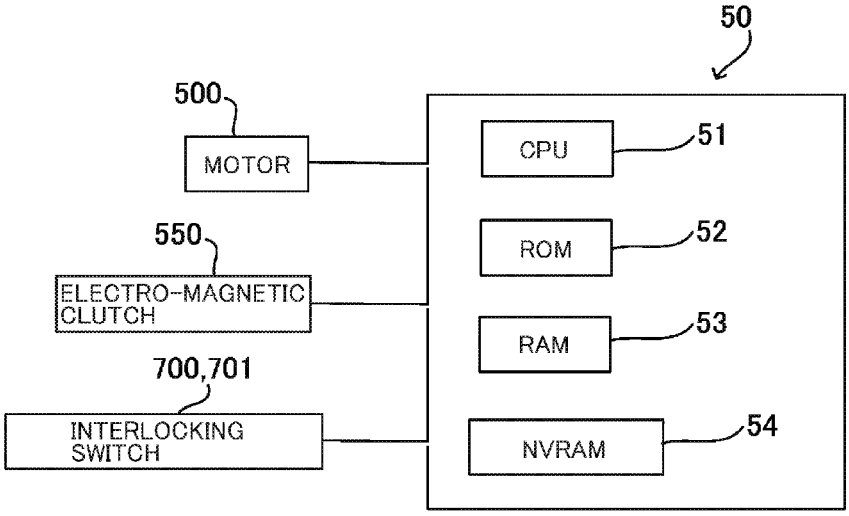
FIG. 2 is a block diagram showing an electrical structure of a control unit in the image forming apparatus according to the embodiment.

Next, electrical structure of the control unit 50 will be described. As shown in FIG. 2, the control unit 50 includes a CPU 51, a ROM 52, a RAM 53, and a NVRAM 54. The control unit 50 is electrically connected to a motor 500, an electromagnetic clutch 550, and the interlock switches 700, 701.

The ROM 52 is configured to store various control programs for controlling the printer 1, image processing program, various setting, and initial value.

The RAM 53 provides a working region into which various control programs are retrieved, and a storing region in which print data or image data transmitted through various interfaces is temporarily stored.

The NVRAM 54 is a storing member having non-volatile property and is used as a storing region in which various settings and print data are stored.

The CPU 51 is configured to control various components of the printer 1 while allowing the processing result to be stored in the RAM 53 and the NVRAM 54 in accordance with a control program retrieved from the ROM 52.

Detection signal is transmitted to the control unit 50 upon detection of the closed position of the front cover 23 and the rear cover 24 by the interlock switches 700 and 701.

Figure 3:
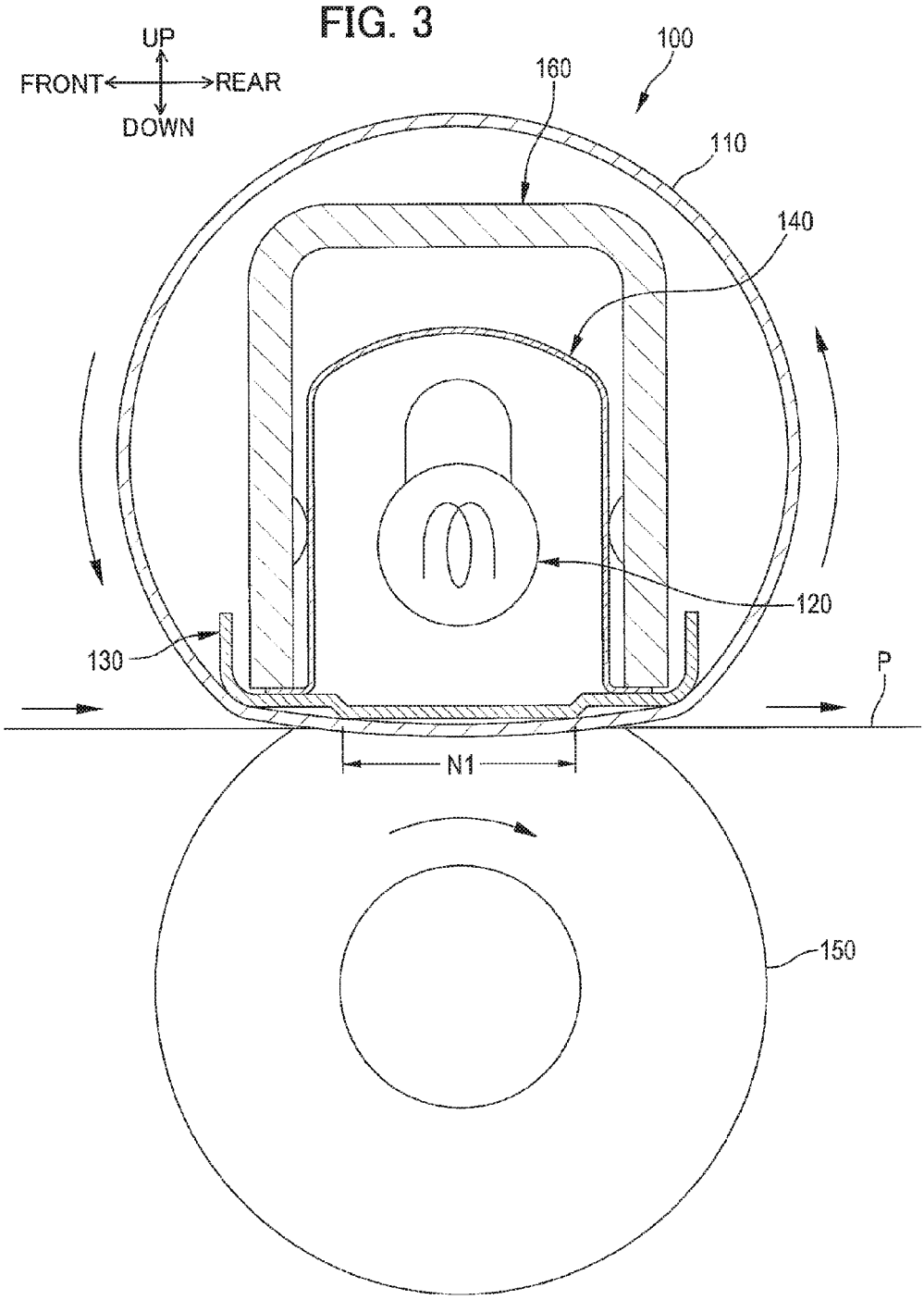
FIG. 3 is a schematic cross-sectional view of a fixing unit in the image forming apparatus according to the embodiment.

The fixing unit 100 will next be described in detail. As shown in FIG. 3, the fixing unit 100 includes a fixing film 110 which is detachably attached to the casing 2 and is an example of a nip member, a halogen lamp 120, a nip plate 130, a reflection plate 140, a pressure roller 150 as an example of a conveying member, a stay 160, and a pressure mechanism 200 (see FIG. 4).

The fixing film 110 is in a form of an endless (tubular) film providing heat resistivity and flexibility. The fixing film 110 has each end guided by guide members 170 (described later) which guide circular movement of the fixing film 110.

The halogen lamp 120 is a typical example of the heater for heating the nip plate 130 and the fixing film 110 thereby heating toner on the sheet P. The halogen lamp 120 is positioned at an internal space of the fixing film 110, and is spaced apart at a prescribed distance from inner surfaces of the fixing film 110 and the nip plate 130.

The nip plate 130 is a plate-like member and is configured to receive radiant heat from the halogen lamp 120, and is configured to be in sliding contact with the inner surface of the tubular fixing film 110. The nip plate 130 transmits radiant heat received from the halogen lamp 120 to the toner on the sheet P through the fixing film 110. The fixing film 110 and the pressure roller 150 nip the sheet P therebetween for conveying the sheet P and for fixing a toner image to the sheet P by the radiant heat received from the halogen lamp 120.

The reflection plate 140 is a member for reflecting radiant heat from the halogen lamp 120 toward an upper surface of the nip plate 130. The reflection plate 140 is spaced apart from the halogen lamp 120 by a predetermined distance.

The pressure roller 150 is disposed below the nip plate 130 so as to nip the fixing film 110 in cooperation with the nip plate 130, while the pressure roller 150 is rotated and is pressed toward the nip plate 130. A nip region N1 is formed by the pressure contact between the pressure roller 150 and the fixing film 110.

As shown in FIG. 1, the pressure roller 150 is connected to a drive source M through a transmission mechanism 151 (described later). The pressure roller 150 is rotationally driven upon input of drive force from the drive source M. Thus, fixing film 110 in pressure contact with the pressure roller 150 is driven.

The transmission mechanism 151 includes a drive gear 152 and a one-way clutch 153. The drive gear 152 is fixed to a rotation shaft of the pressure roller 150. The one-way clutch 153 includes a small diameter gear 154 in meshing engagement with the drive gear 152, a large diameter gear 155 in meshing engagement with the drive source M, and a clutch mechanism (not shown) provided between the small diameter gear 154 and the large diameter gear 155.

The clutch mechanism is configured to rotate the small diameter gear 154 in a counterclockwise direction by the transmission of the driving force of the large diameter gear 155 to the small diameter gear 154 upon counterclockwise rotation of the large diameter gear 155 as a result of driving of the drive source M. Thus, the pressure roller 150 can be rotated in the counterclockwise direction in FIG. 1.

As shown in FIG. 3, the stay 160 supports front and rear end portions of the nip plate 130 through flange portions 142 of the reflection plate 140 for ensuring rigidity of the nip plate 130.

Figure 4:
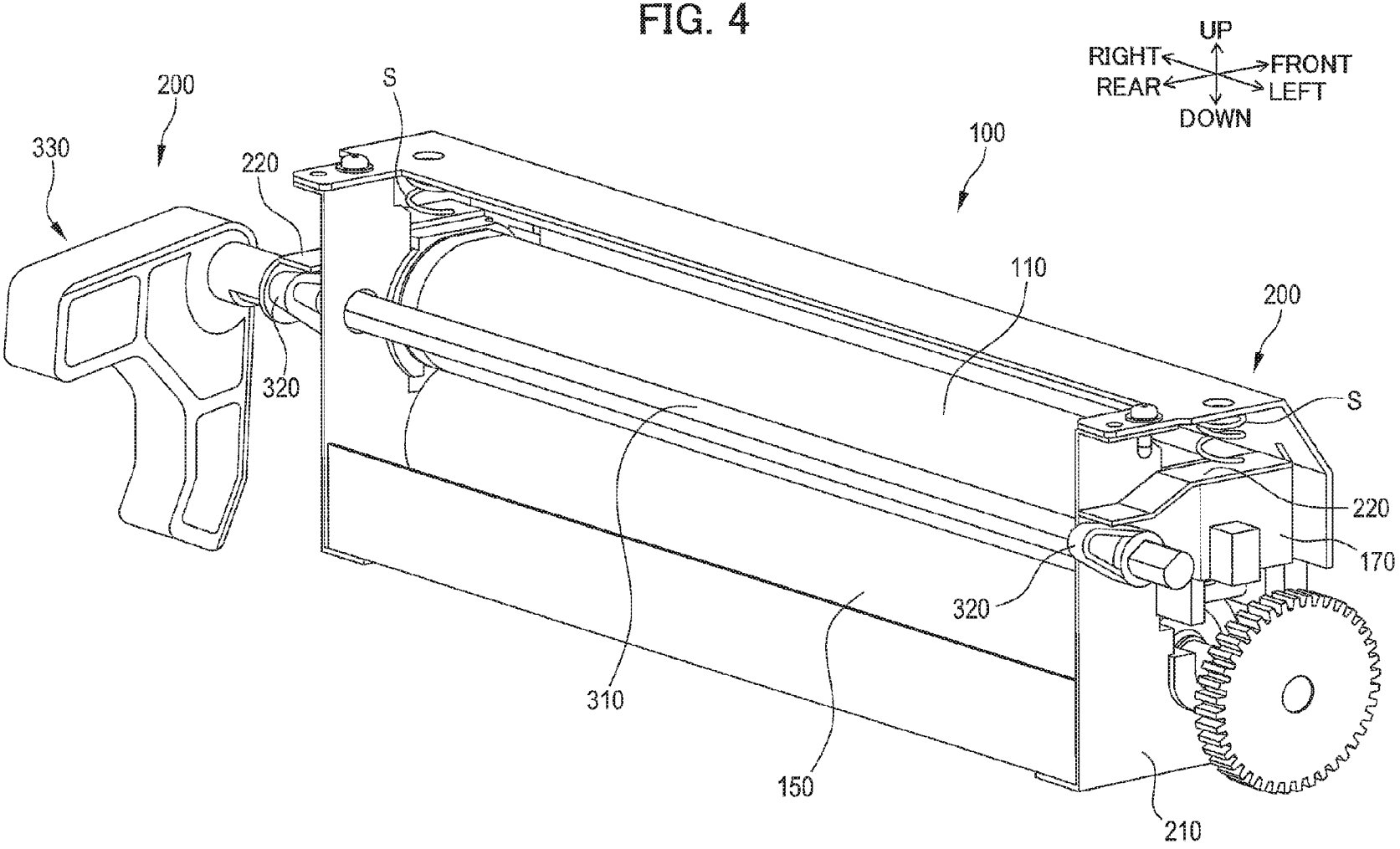
FIG. 4 is a perspective view of a pressure mechanism in the image forming apparatus according to the embodiment.

As illustrated in FIG. 4, guide members 170 are formed at both left and right end portions of the fixing unit 100, respectively. The guide members 170 support upper portions of left and right end portions of the stay 160. The guide members 170 are positioned adjacent to the left and right end portions of the fixing film 110 and mainly regulate movement of the fixing film 110 in the leftward/rightward direction.

The pressing mechanism 200 mainly includes a fixing frame 210, a support plate 220, and coil springs S as examples of the urging member. The pressing mechanism 200 is provided at both left and right end portions of the fixing unit 100.

The fixing frame 210 rotatably supports the pressure roller 150 and supports the guide members 170 movably with respect to the pressure roller 150. Specifically, the fixing frame 210 has left and right side walls, and the left and right side walls are provided with grooves (not illustrated) that support the pressure roller 150. Further, the left and right side walls of the fixing frame 210 are provided with other grooves (not illustrated) that movably support the guide members 170 in the upward/downward direction.

The support plates 220 are fixed to upper surfaces of the guide members 170 and each support plate 220 has a bent shape extending rearward.

The coil springs S are provided between the support plates 220 and upper walls of the fixing frame 210. The coil springs S urge the support plates 220 and the guide members 170 downward, thereby causing the nip plate 130 and the fixing film 110 to be biased toward the pressure roller 150.

In the present embodiment, the coil springs S urge the fixing film 110 toward the pressure roller 150. Alternatively, the coil springs S may urge the pressure roller 150 toward the fixing film 110.

Figure 5A:
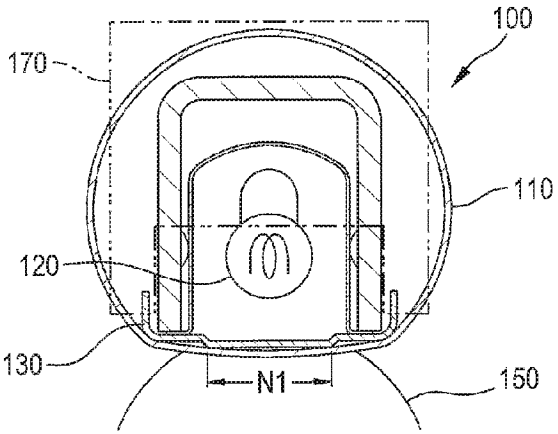
FIG. 5A is a schematic cross-sectional view of the fixing unit and showing a state where high nip pressure is generated.

Accordingly, a suitable nip pressure is applied between the fixing film 110 and the pressure roller 150. The nip pressure in the present specification refers to a pressure at a nip area. Hereinafter, a pressure at a nip area N1 in a state where the nip plate 130 is at a first position in FIG. 5A is referred to as "strong nip".

As illustrated in FIG. 4, cams 320 are provided below rear end portions of the support plates 220. The cams 320 are fixed at left and right end portions of a shaft 310 extending in the leftward/rightward direction and can abut against the support plates 220 from below to push up the support plates 220. The shaft 310 is rotatably supported by the fixing frame 210.

An arm member 330, as an example of the changing portion, formed into a substantially L-shape is pivotably fixed to a right end portion of the shaft 310, which is inserted to the arm member 330. The shaft 310 and the left and right cams 320 are integrally pivotable in conjunction with the pivot of the arm member 330.

When the arm member 330 pivots, each cam 320 is conjunctively pivoted and abuts against the each rear end portion of the support plates 220 to thereby push up the support plates 220. When the support plates 220 are pushed up, each of the left and right guide members 170 is moved up against the urging force of the coil springs S. As described above, the pivot of the arm member 330 acts on the coil springs S through the cams 320 and the support plates 220 to change the urging force of the coil spring S.

As described above, the pivot of the arm member 330 moves the guide members 170 up and down with respect to the fixing frame 210, thereby moving up and down the nip plate 130 supported by the guide members 170 with respect to the pressure roller 150. Accordingly, the nip pressure can be changed.

In the present embodiment, the fixing film 110 and the pressure roller 150 are used to fix a toner image. Alternatively, a conventional heating roller and a pressure roller may be used to fix a toner image.

Figure 6:
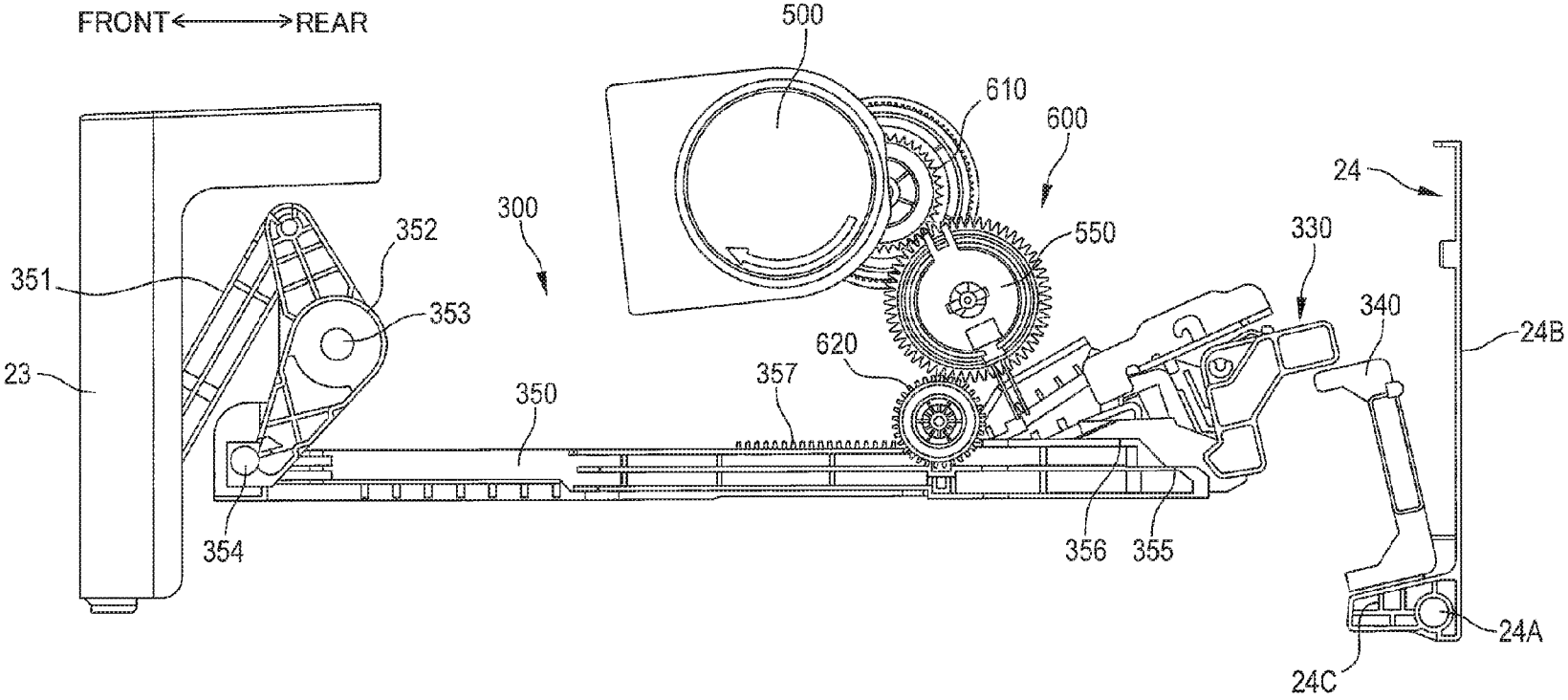
FIG. 6 is a view of an interlocking mechanism in a state where a front cover and a rear cover are closed in the image forming apparatus according to the embodiment.

As illustrated in FIG. 6, the interlocking mechanism 300 is provided in the casing 2. The interlocking mechanism 300 is a mechanism for changing the nip pressure in conjunction with opening and closing operations of the front cover 23. The following describes in detail the interlocking mechanism 300.

The interlocking mechanism 300 mainly includes a slide member 340, a push-up part 24C, a linear motion member 350 as an example of the first transmission portion, a first link 351, and a second link 352. The first link 351 and the second link 352 are examples of a link member.

The slide member 340 is a member substantially extending in the upward/downward direction and is disposed between the arm member 330 and the push-up part 24C. The slide member 340 is supported by the casing 2 so as to be slidable in a longitudinal direction thereof.

Figure 7A:
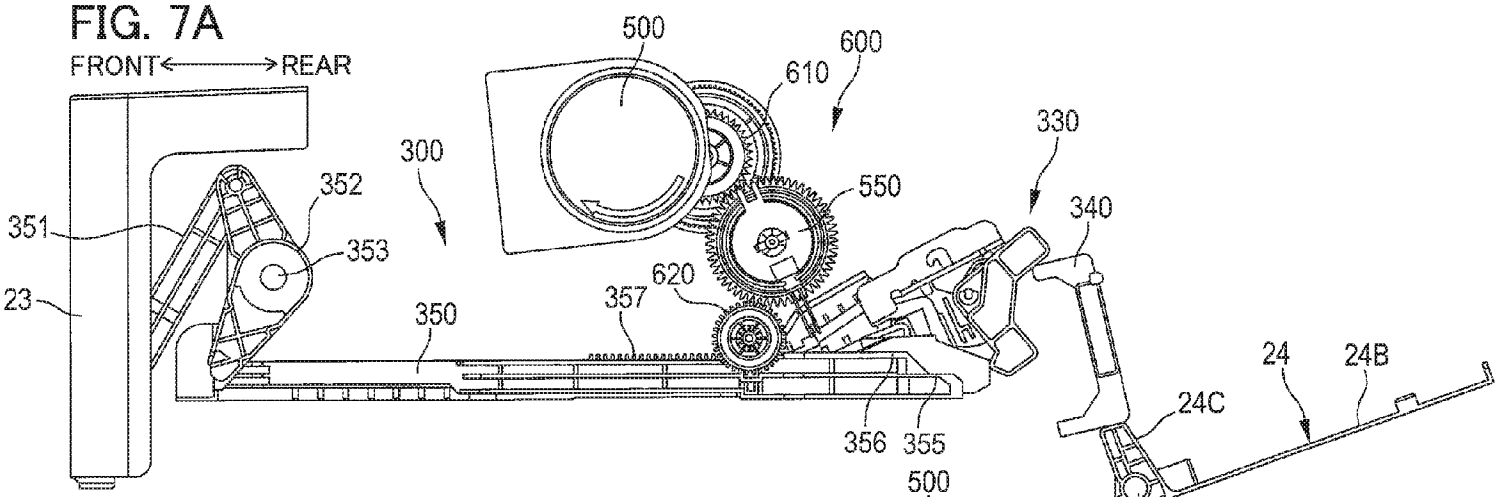
FIG. 7A is a view of the interlocking mechanism in a state where the front cover is closed and the rear cover is opened in the image forming apparatus according to the embodiment.

The push-up part 24C is formed so as to extend in a direction perpendicular to the cover body 24B from a pivot center 24A of the rear cover 24 and abuts against a lower end portion of the slide member 340. As illustrated in FIG. 7A, the push-up part 24C pushes up the slide member 340 during the opening operation of the rear cover 24, causing the slide member 340 to be slid upward. When the slide member 340 is slid upward, an upper end portion of the slide member 340 abuts against the arm member 330, causing the arm member 330 to be rotated in the counterclockwise direction in the drawing.

When the rear cover 24 is closed in this state, the slide member 340 is slid downward. Then, in conjunction with the slide movement, the arm member 330 is rotated in the clockwise direction in the drawing by the urging force of the coil springs S to return to its original position.

Figure 5B:
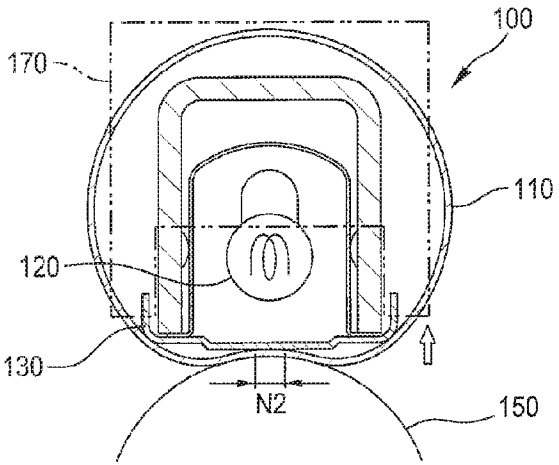
FIG. 5B is a schematic cross-sectional view of the fixing unit and showing a state where low nip pressure is generated.

In a state illustrated in FIG. 7A where the rear cover 24 is fully opened, the slide member 340 is positioned at the topmost position to cause each of the left and right cams 320 to push up the support plate 220. In this state, as illustrated in FIG. 5B, the nip plate 130 is at a second position separated more from the pressure roller 150 in the upward direction than a first position in FIG. 5A, and forms a nip area N2 between the pressure roller 150 and the fixing film 110. The pressure at the nip area N2 is defined as "weak nip" which is lower pressure than the strong nip.

As illustrated in FIG. 6, the linear motion member 350 is a rod-like member extending in the frontward/rearward direction and is disposed between the front cover 23 and the arm member 330. The linear motion member 350 is a member for changing the nip pressure in conjunction with the opening operation of the front cover 23. A front end portion of the linear motion member 350 is connected to the front cover 23 via first and second links 351 and 352.

The first link 351 is formed into a long-rod shape and pivotably connected to the front cover 23.

The second link 352 is disposed between the first link 351 and the linear motion member 350 and pivotably supported by the casing 2. The second link 352 is pivotable about a link shaft 353, which rotatably supports the second link 352. One end of the second link 352 is pivotably connected to the first link 351, and the other end has an extension part 354 extending in the leftward/rightward direction from the second link 352. The extension part 354 abuts against the front end portion of the linear motion member 350 in a state where the front cover 23 and the rear cover 24 are closed.

Figure 7B:
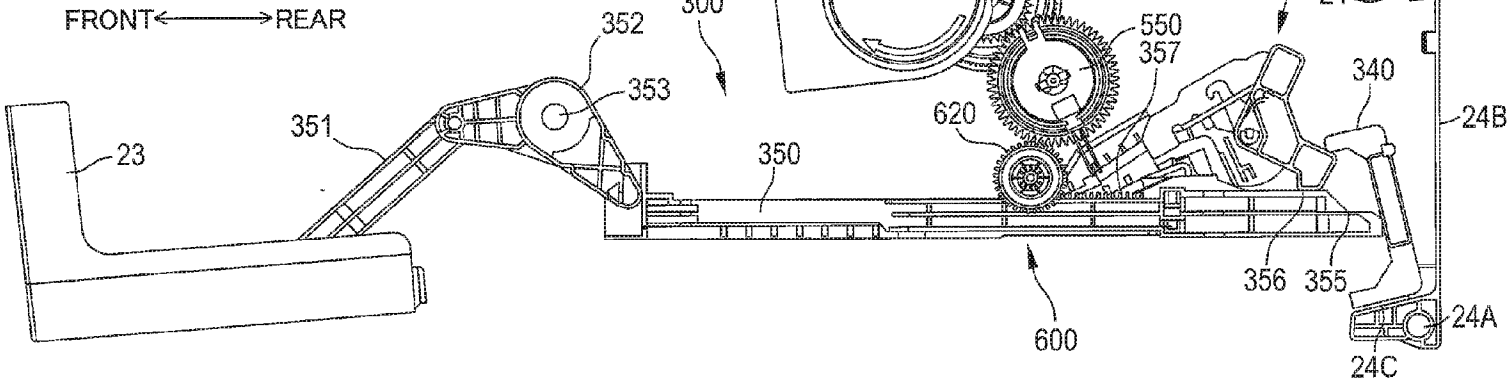
FIG. 7B is a view of the interlocking mechanism in a state where the front cover is opened and the rear cover is closed in the image forming apparatus according to the embodiment.

As illustrated in FIG. 7B, when the front cover 23 is opened, the first link 351 is moved forward. In conjunction with this movement, the second link 352 is rotated in the counterclockwise direction in the drawing to push rearward the linear motion member 350 through the extension part 354 formed at the other end of the second link 352.

As described above, when the second link 352 is rotated in the counterclockwise direction in the drawing in conjunction with the movement of the front cover 23, the linear motion member 350 is linearly moved rearward. As a result, the arm member 330 abuts against first and second abutment parts 355 and 356 which are formed at a rear end portion of the linear motion member 350. The first and second abutment parts 355 and 356 are examples of the first abutment portion.

The first and second abutment parts 355 and 356 are each formed into a flat surface extending in the frontward/rearward direction. The first abutment part 355 is positioned downward of the second abutment part 356. The first and second abutment parts 355 and 356 abut against a lower end portion of the arm member 330 from below to rotate the arm member 330 in the counterclockwise direction.

Figure 5C:
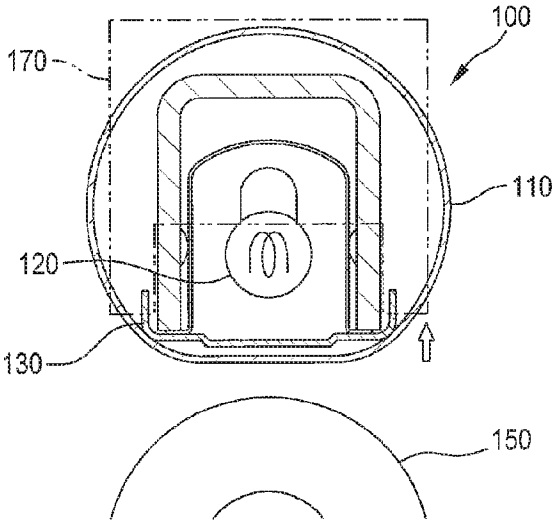
FIG. 5C is a schematic cross-sectional view of the fixing unit and showing a state where nip pressure is not generated.

In a state illustrated in FIG. 7B where the front cover 23 is fully opened, the linear motion member 350 is positioned at the rearmost position. In this state, the arm member 330 and the second abutment part 356 abut against each other, and each of the left and right cams 320 pushes up the support plate 220. Further, in this state, as illustrated in FIG. 5C, the nip plate 130 is positioned at a third position separated more from the pressure roller 150 in the upward direction than the second position in FIG. 5B. As a result, no nip pressure is applied between the pressure roller 150 and the fixing film 110.

In the present embodiment, in the full-open state of the front cover 23, no nip pressure is applied between the pressure roller 150 and the fixing film 110. Alternatively, a predetermined nip pressure may be applied between the pressure roller 150 and the fixing film 110 (referred to as a "non-pressure state", hereinafter).

The following describes an example of operation of the printer 1. When printing is performed with the front cover 23 and the rear cover 24 closed, a sheet P is conveyed to the nip area N1 at which the nip pressure is the strong nip, and a toner image is thermally fixed onto the sheet P.

When printing is performed for a thick paper as an example of the recording sheet, such as an envelope thicker than the sheet P, the rear cover 24 is opened as illustrated in FIG. 7A. At this time, the nip area N2 having a lower nip pressure than the nip area N1 is formed, so that the image can be thermally fixed onto a thick paper such as an envelope under a suitable nip pressure. Then, the thick paper that has passed through the fixing unit 100 is not fed to the discharge roller R, and is discharged from the first opening portion 2A to be placed on the rear cover 24.

For example, when a jam occurs inside the fixing unit 100 in a state where printing is performed with the front cover 23 and the rear cover 24 closed, a user opens the front cover 23 and takes the process unit 6 out of the casing 2. At this time, the nip plate 130 is positioned at the third position (FIG. 5C) separated from the pressure roller 150, and thus the sheet P is not held between the fixing film 110 and the pressure roller 150, so that the sheet P can easily be pulled out.

As described above, when printing is performed for a thick paper or the like, or when jam processing is performed, it is necessary to rotate the arm member 330 against the urging force of the coil springs S through the front cover 23 and the rear cover 24.

Thus, in the present embodiment, in order to improve the operability of the front cover 23, the printer 1 includes the motor 500, the electromagnetic clutch 550 as an example of the switching member, and a motor transmission mechanism 600 as the second transmission portion. The motor transmission mechanism 600 transmits a drive force of the motor 500 to the linear motion member 350 to allow the nip pressure to be changed by the drive force of the motor 500.

As illustrated in FIG. 6, the motor 500 is provided inside the casing 2. The motor transmission mechanism 600 includes a first gear 610 meshing with the motor 500 and a second gear 620 meshing with a gear part 357 formed on an upper surface of the linear motion member 350.

The electromagnetic clutch 550 is disposed between the first gear 610 and the second gear 620. The electromagnetic clutch 550 is a conventional electromagnetic clutch and meshes with the first and second gears 610 and 620.

The electromagnetic clutch 550 provides a transmission state and a cutoff state. In the transmission state, the motor transmission mechanism 600 transmits the drive force of the motor 500 to the linear motion member 350. In the cutoff state, the motor transmission mechanism 600 does not transmit the drive force of the motor 500 to the linear motion member 350. Specifically, when the electromagnetic clutch 550 is powered, the electromagnetic clutch 550 transmits the drive force of the motor 500 from the first gear 610 to the second gear 620. When power to the electromagnetic clutch 550 is cut off, the electromagnetic clutch 550 does not transmit the drive force of the motor 500 between the first gear 610 and the second gear 620.

When power to the electromagnetic clutch 550 is cut off, the electromagnetic clutch 550 idles. As a result, the first gear 610 and the second gear 620 are in an idle state.

In the present embodiment, the electromagnetic clutch 550 is used to switch between the transmission state and the cutoff state. Alternatively, a conventional swing gear that can swing between the transmission state and the cutoff state may be used.

The following describes in detail a nip pressure change process that the control unit 50 executes. In the nip pressure change process, rotation of the motor 500 is controlled. The control unit 50 executes the nip pressure processing at a predetermined time interval.

Figure 8:
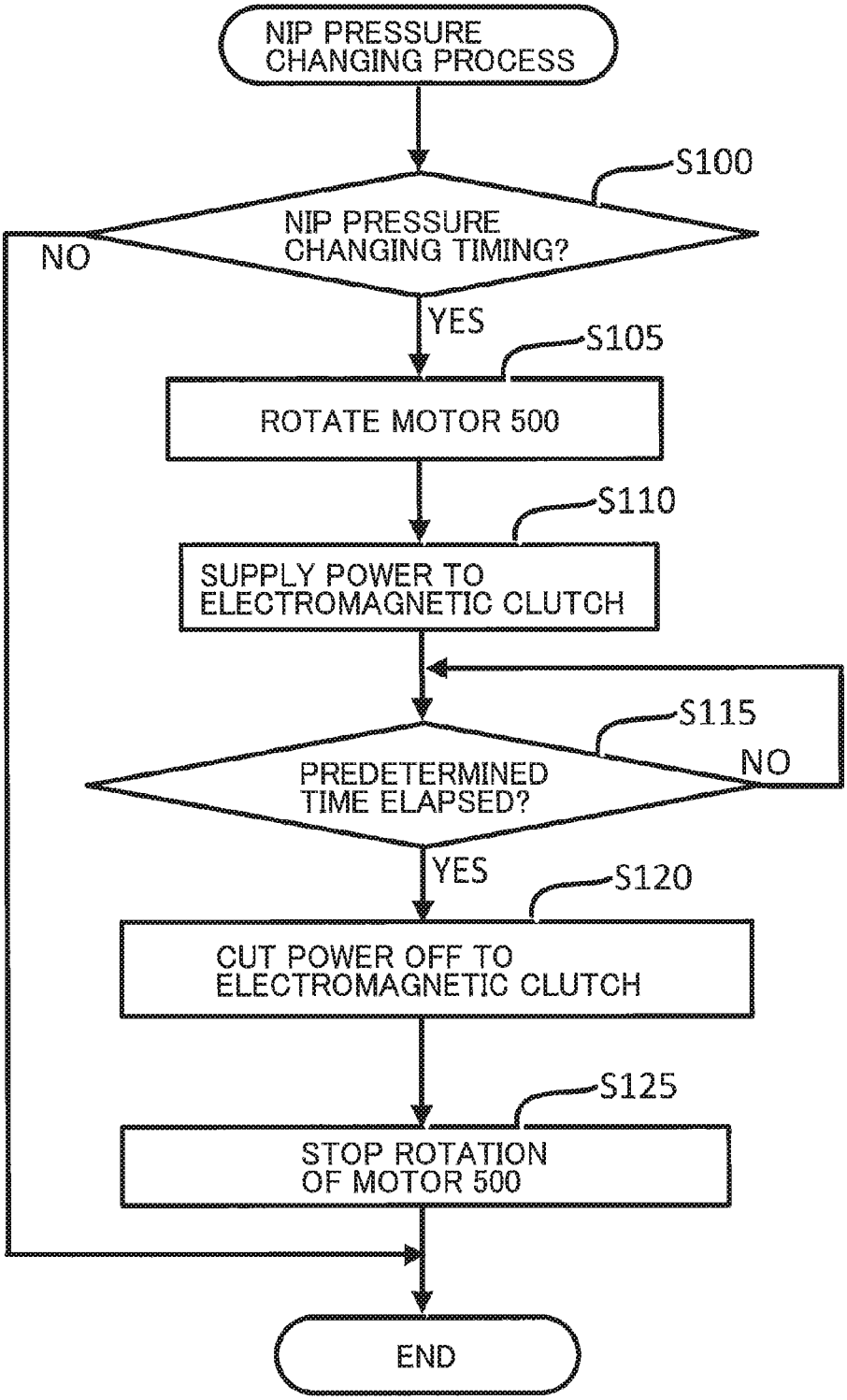
FIG. 8 is a flowchart showing a process for changing nip pressure in the image forming apparatus according to the embodiment.

As illustrated in FIG. 8, in the nip pressure change process, the control unit 50 determines whether it is a timing to change the nip pressure (S100). When determining that it is a timing to change the nip pressure (YES in S100), the control unit 50 rotates the motor 500 (S105) and supplies power to the electromagnetic clutch 550 (S110).

In S105, when lowering the nip pressure, the control unit 50 drives the motor 500 in the clockwise direction in FIG. 6. Otherwise, when increasing the nip pressure, the control unit 50 drives the motor 500 in the counterclockwise direction. The nip pressure change timing is, for example, a time when a jam occurs or a time during a conventional warming up operation, which is usually performed immediately after power-ON operation.

As illustrated in FIG. 8, the control unit 50 determines whether a predetermined time has elapsed after supplying power to the electromagnetic clutch 550 in S110 (S115). When determining that a predetermined time has elapsed (YES in S115), the control unit 50 cuts off power to the electromagnetic clutch 550 (S120), stops rotating the motor 500 (S125), and ends the nip pressure change process.

When determining that a predetermined time has not elapsed (NO in S115), the control unit 50 repeats the step S115. The predetermined time in S115 may be an arbitrary time period required to move the linear motion member 350 for changing the nip pressure.

Inside the casing 2, three conventional sensors for detecting a position of the linear motion member 350 in the frontward/rearward direction are arranged at a predetermined interval from one another in the frontward/rearward direction. The three sensors are provided corresponding to different nip pressures and arranged at a predetermined interval so as to detect ribs formed in the linear motion member 350 (not illustrated). When detecting the rib, each of the three sensors outputs a detection signal to the control unit 50. With this configuration, the control unit 50 can detect a nip pressure application state on the basis of the detection signal from each of the three sensors.

In S115, the control unit 50 uses, as the predetermined time, a time corresponding to the nip pressure application state. Specifically, the predetermined time used during changing the nip pressure from the strong nip to the weak nip is shorter than a predetermined time during changing the nip pressure from the strong nip to the non-pressure state.

When determining in S100 that it is not a timing to change the nip pressure (NO in S100), the control unit 50 ends the nip pressure change process.

The following describes operation of the linear motion member 350 when the control unit 50 executes the nip pressure change process in a state as illustrated in FIG. 6, where the front cover 23 and the rear cover 24 are closed and the strong nip is applied.

When the motor 500 is driven in the clockwise direction and the electromagnetic clutch 550 is powered in a state illustrated in FIG. 6 where the strong nip is applied, the second gear 620 is rotated in the counterclockwise direction in the drawing. Then, the linear motion member 350 is moved rearward in conjunction with the rotation of the second gear 620, which is inter locked with the linear motion member 350.

Figure 9A:
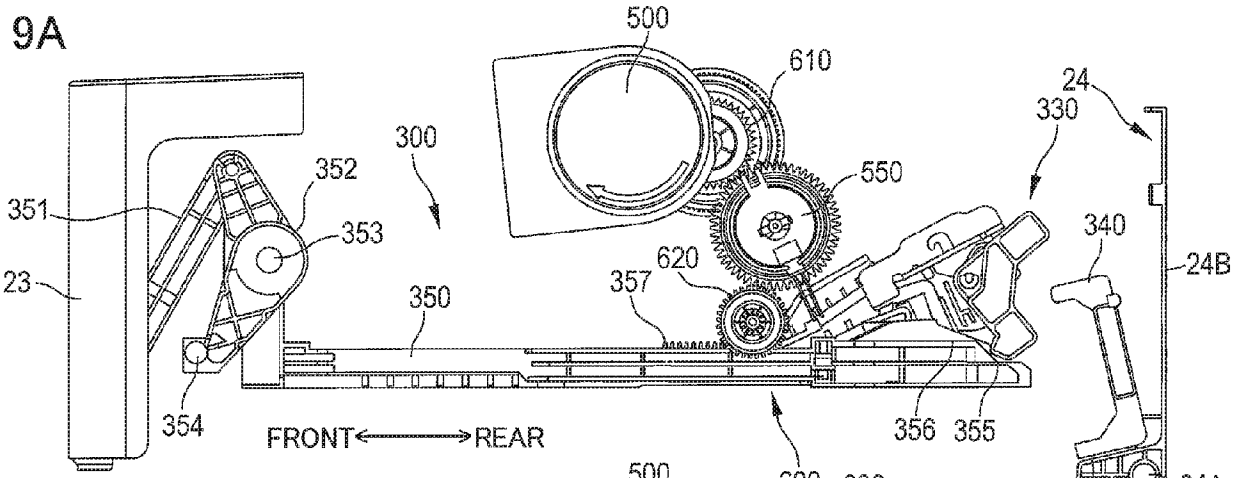
FIG. 9A is a view of the interlocking mechanism in a state where low nip pressure is generated by way of driving force from a motor in the image forming apparatus according to the embodiment.

When the linear motion member 350 is moved rearward by a predetermined distance, the first abutment part 355 and the arm member 330 abut against each other as illustrated in FIG. 9A, thereby changing the nip pressure to the weak nip. Then, the control unit 50 cuts off power to the electromagnetic clutch 550, and the drive force of the motor 500 is not transmitted to the second gear 620. As a result, the rearward movement of the linear motion member 350 is stopped. Thus, the weak nip is maintained.

In this state, a direction of the force transmitted from the coil springs S to the linear motion member 350 through the arm member 330 is perpendicular to the moving direction of the linear motion member 350. Accordingly, the linear motion member 350 is prevented from being moved by the urging force of the coil springs S, when the control unit 50 cuts off power to the electromagnetic clutch 550. As a result, even when the control unit 50 cuts off power to the electromagnetic clutch 550, the application of the weak nip can be maintained.

Figure 9B:
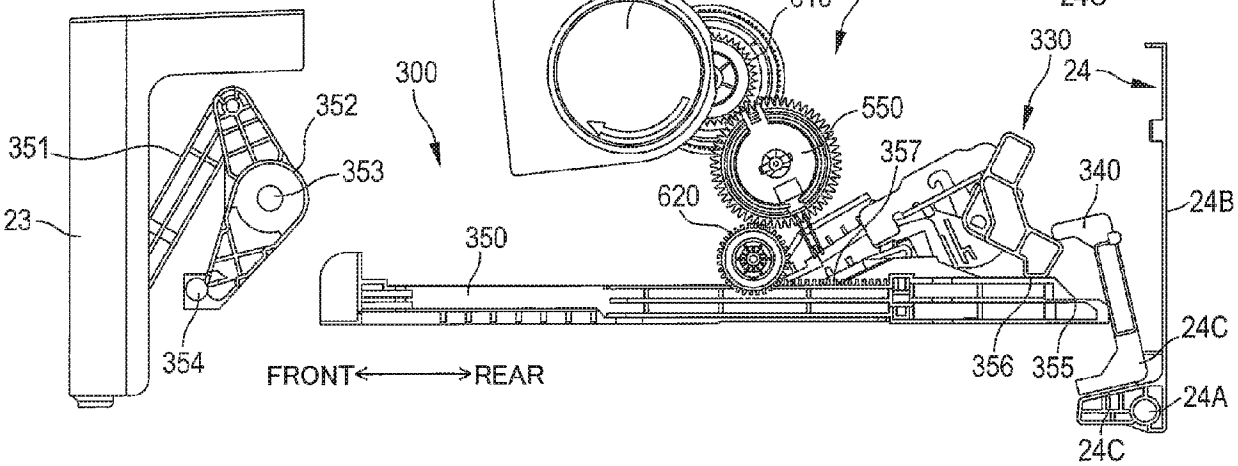
FIG. 9B is a view of the interlocking mechanism in a state where nip pressure is not generated by way of driving force from the motor in the image forming apparatus according to the embodiment.

In addition to this state, if the control unit 50 supplies power to the electromagnetic clutch 550 to move the linear motion member 350 rearward by a predetermined distance from a position illustrated in FIG. 9A, the second abutment part 356 and the arm member 330 abut against each other, as illustrated in FIG. 9B. As a result, the nip pressure is changed to the non-pressure state.

As described above, the motor transmission mechanism 600 provided with the first and second gears 610 and 620 transmits the drive force of the motor 500 to the linear motion member 350, thereby moving the linear motion member 350 and changing the nip pressure. As a result, the nip pressure can be changed without intervention of user's operation.

Further, the cutoff of power to the electromagnetic clutch 550 interrupts a drive transmission path between the motor 500 and the linear motion member 350, so that a force required to move the linear motion member 350 can be reduced as compared to a case where the drive transmission path is not interrupted. This can also reduce the force required to move the front cover 23, thereby reducing a burden associated with opening/closing operations of the front cover 23 for changing the nip pressure.

Further, in the present embodiment, the movement of the front cover 23 and the drive force of the motor 500 are transmitted to the arm member 330 to thereby change the nip pressure by commonly employing the linear motion member 350. By sharing the mechanism for changing the nip pressure as described above, the dimension of the printer 1 can be reduced.

In a state as illustrated in FIG. 9B, where no nip pressure is applied, the lower end portion of the arm member 330 abuts against the second abutment part 356 in a horizontal posture. Accordingly, the direction of the force transmitted from the coil springs S to the linear motion member 350 through the arm member 330 is perpendicular to the moving direction of the linear motion member 350. The linear motion member 350 is therefore prevented from being moved by the urging force of the coil springs S, when the control unit 50 cuts off power to the electromagnetic clutch 550. As a result, even when the control unit 50 cuts off power to the electromagnetic clutch 550, the non-pressure state can be maintained.

In the state illustrated in FIG. 9B, where no nip pressure is applied, if the motor 500 is rotated in the counterclockwise direction in the drawing and the electromagnetic clutch 550 is powered, the second gear 620 is rotated in the clockwise direction in the drawing. Then, the linear motion member 350 is moved forward in conjunction with the rotation of the second gear 620, which is interlocked with the linear motion member 350.

When the linear motion member 350 is moved forward by a predetermined distance, the nip pressure is increased to the weak nip as illustrated in FIG. 9A. Then, the control unit 50 cuts off power to the electromagnetic clutch 550, and the forward movement of the linear motion member 350 is stopped, so that the weak nip application state is maintained.

Further, if the control unit 50 supplies power to the electromagnetic clutch 550 to move the linear motion member 350 forward by a predetermined distance from a position illustrated in FIG. 9A, the nip pressure is increased to the strong nip as illustrated in FIG. 6. Then, the control unit 50 cuts off power to the electromagnetic clutch 550, and the application of the strong nip is therefore maintained.

As described above, in the present embodiment, the nip pressure can be changed by the drive force of the motor 500 and the opening operation of the front cover 23 or the rear cover 24. Thus, when the motor 500 cannot be driven due to, for example, cut off of power supply to the printer 1, the nip pressure can be changed by the opening operation of the front cover 23 or the rear cover 24. Otherwise, when the motor 500 can be driven, the nip pressure can be changed by the drive force of the motor 500.

However, for example, if the front cover 23 is opened in a state where the electromagnetic clutch 550 is powered, the linear motion member 350, which is being connected to the motor 500 through the drive transmission path, needs to be pushed rearward. Accordingly, the force required to push the linear motion member 350 is increased as compared to a case where the electromagnetic clutch 550 is not powered. As a result, the force required to open the front cover 23 is increased, so that the operability of the front cover 23 may be deteriorated.

Further, for example, if the front cover 23 is opened in the state illustrated in FIG. 9B, where the linear motion member 350 has been moved forward by the drive force of the motor 500, the extension part 354 and the linear motion member 350 may interfere with each other and result in damage of the extension part 354 or the linear motion member 350.

Thus, in the present embodiment, the control unit 50 executes power cutting process and power supplying process while considering the above problems. The control unit 50 executes the power cutting process and the power supplying process at a predetermined time interval.

Figure 10:
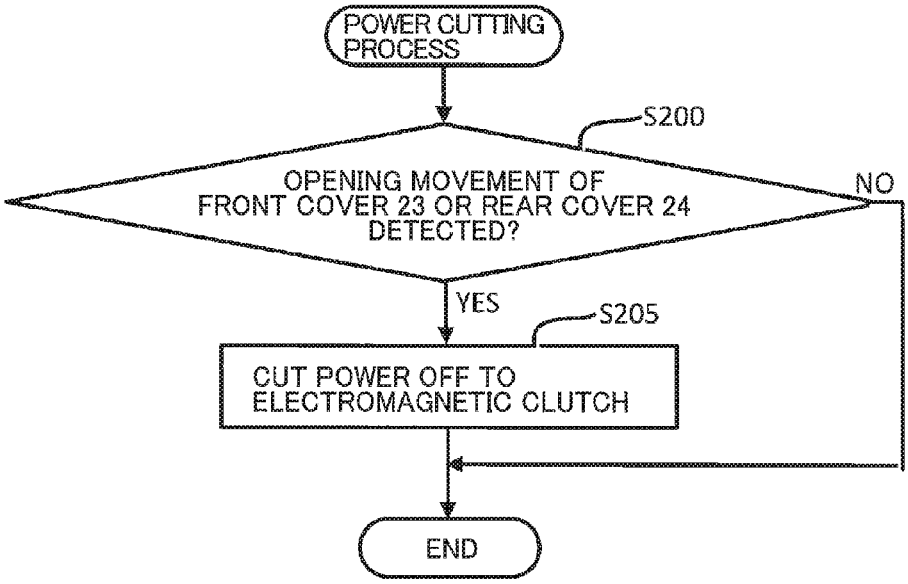
FIG. 10 is a flowchart showing power cutting process in the image forming apparatus according to the embodiment.

As illustrated in FIG. 10, in the power cutting process, the control unit 50 determines, based on a detection signal outputted from the interlock switch 700 or 701, whether the opening operation of the front cover 23 or the rear cover 24 has been detected (S200). Specifically, the control unit 50 determines that the opening operation of at least one of the front cover 23 and the rear cover 24 has been detected, when the signal from the interlock switch 700 or 701 to the control unit 50 is changed to an undetected state from a detected state.

When determining in S200 that opening operation of at least one of the front cover 23 and the rear cover 24 has been detected (YES in S200), the control unit 50 cuts off power to the electromagnetic clutch 550 (S205) and ends the power cutting process.

When determining in S200 that opening operation of the front cover 23 or the rear cover 24 has not been detected (No in S200), the control unit 50 ends the power cutting process.

As described above, when detecting the opening operation of at least one of the front cover 23 and the rear cover 24, the control unit 50 cuts off power to the electromagnetic clutch 550 to interrupt the drive transmission path between the motor 500 and the linear motion member 350. Thus, the force required to move the linear motion member 350 can be reduced as compared to a case where the drive transmission path is not interrupted. Accordingly, the three required to open or close the front cover 23 can be reduced, and the burden associated with opening or closing the front cover 23 to change the nip pressure is therefore reduced.

In the present embodiment, the control unit 50 cuts off power to the electromagnetic clutch 550. Alternatively, each of the interlock switches 700 and 701 may have a conventional cutoff mechanism that cuts off power to the electromagnetic clutch 550. With this configuration, the interlock switch 700 or 701 cuts off power to the electromagnetic clutch 550 in conjunction with the opening operation of the front cover 23 or the rear cover 24.

Figure 11:
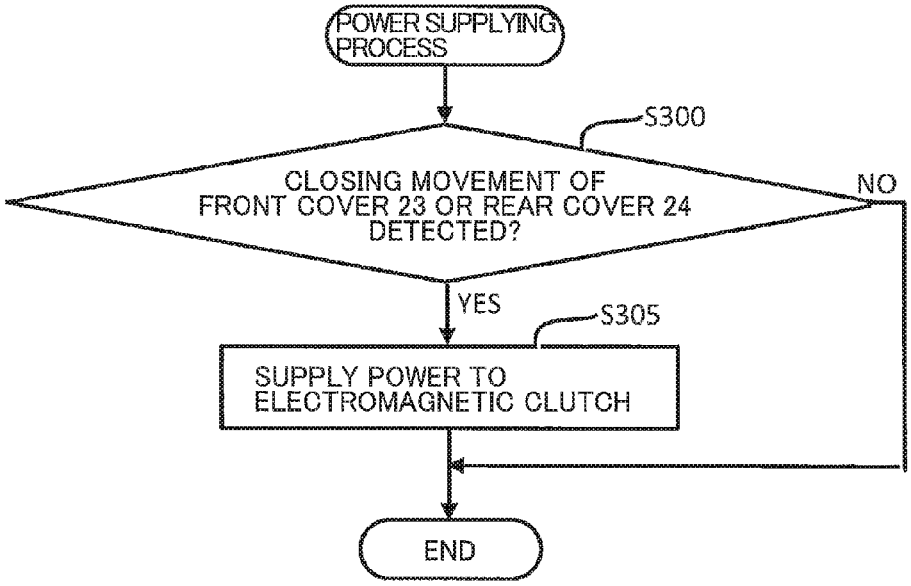
FIG. 11 is a flowchart showing power supplying process in the image forming apparatus according to the embodiment.

Further, as illustrated in FIG. 11, in the power supplying process, the control unit 50 determines whether the closing operation of at least one of the front cover 23 and the rear cover 24 has been detected (S300). Specifically, the control unit 50 determines that the closing operation of one of the front cover 23 and the rear cover 24 has been detected, when the signal from the interlock switch 700 or 701 to the control unit 50 is changed from the undetected state to the detected state.

When determining in S300 that closing operation of at least one of the front cover 23 and the rear cover 24 has been detected (YES in S300), the control unit 50 supplies power to the electromagnetic clutch 550 (S305) and ends the power supplying process.

When determining in S300 that closing operations of the front cover 23 or the rear cover 24 has not been detected (NO in S300), the control unit 50 ends the power supplying process.

As described above, when detecting the opening operation of at least one of the front cover 23 and the rear cover 24, the control unit 50 cuts off power to the electromagnetic clutch 550. When detecting the closing operation of at least one of the front cover 23 and the rear cover 24, the control unit 50 supplies power to the electromagnetic clutch 550. Accordingly, power to the electromagnetic clutch 550 is reliably cut off during the opening or closing operation of the front cover 23. Therefore, the drive transmission path between the motor 500 and the linear motion member 350 is reliably interrupted during the opening or closing operation of the front cover 23, thereby reducing the burden associated with opening or closing operation of the front cover 23 to change the nip pressure.

While the description has been made in detail with reference to specific embodiment thereof, it would be apparent to those skilled in the art that various changes and modifications may be made therein without departing from the spirit and scope of the above described embodiment.

In the above embodiment, the control unit 50 executes the processing steps described above. Alternatively, another CPU may execute at least some of the steps, or one or more ASICs may execute at least some of the steps.

What is claimed is:

1. An image forming apparatus comprising:

a housing formed with an opening;

a conveying member configured to convey a recording sheet;

a nip member having a nip portion configured to nip the recording sheet in cooperation with the conveying member;

an urging member configured to urge one of the conveying member and the nip member toward another of the conveying member and the nip member;

a changing portion configured to change an urging force of the urging member;

an opening/closing member configured to move between an opening position to uncover the opening and a closing position to cover the opening, the opening/closing member being configured to generate a moving force when being moved;

a first transmission portion configured to be moved by the moving force and transmit the moving force to the changing portion;

a motor configured to generate a drive force;

a second transmission portion configured to transmit the drive force to the first transmission portion to generate the moving force; and a switching member configured to switch to one of a transmitting state and a cutoff state, the switching member interrupting the transmission of the drive force from the second transmission portion to the first transmission portion in the cutoff state, and the second transmission portion transmitting the drive force to the first transmission portion in the transmitting state.

2. The image forming apparatus according to claim 1, further comprising:

a position detector configured to detect the closing position of the opening/closing member as a detected condition; and a control unit configured to control the switching member to switch to the cutoff state when the detected condition is changed to an undetected condition where the position detector fails to detect that the opening/closing member is positioned at the closing position.

3. The image forming apparatus according to claim 2, wherein the control unit is configured to control the switching member to switch to the transmitting state when the undetected condition is changed to the detected condition.

4. The image forming apparatus according to claim 1, wherein the switching member comprises an electromagnetic clutch.

5. The image forming apparatus according to claim 1, wherein the changing portion comprises an arm member that is pivotably movable and configured to change the urging force in accordance with pivotal movement thereof.

6. The image forming apparatus according to claim 5, wherein the first transmission portion comprises a linear motion member linearly movable in interlocking relation to movement of the opening/closing member.

7. The image forming apparatus according to claim 6, wherein the linear motion member has an abutment portion configured to abut against the arm member to pivotally move the arm member.

8. The image forming apparatus according to claim 7, wherein the linear motion member is movable in a moving direction; and wherein, when the abutment portion abuts against the arm member to pivotally move the arm member, the urging force transmitted to the linear motion member from the urging member through the arm member is directed in a direction perpendicular to the moving direction.

9. The image forming apparatus according to claim 6, further comprising:

a link member configured to link the opening/closing member to the linear motion member; and wherein, when the opening/closing member is moved from the closing position to the opening position, the link member transmits the moving force to the linear motion member.

10. The image forming apparatus according to claim 9, wherein one end of the link member is configured to be coupled to the opening/closing member; and wherein the link member has an abutment portion at the other end thereof configured to abut against the linear motion member to transmit the moving force to the linear motion member and linearly move the linear motion member.

11. The image forming apparatus according to claim 6, wherein the linear motion member has a gear part formed on a surface thereof; and wherein the second transmission portion comprises a gear mechanism configured to mesh with the gear part; and wherein the switching member is configured to interrupt transmission of the drive force from the motor to the gear mechanism in the cutoff state and transmit the drive force from the motor to the gear mechanism in the transmitting state.

* * * * *